US006283880B1

(12) United States Patent
Barrie

(10) Patent No.: US 6,283,880 B1
(45) Date of Patent: Sep. 4, 2001

(54) BROADHEAD WITH REPLACEABLE BLADE CARRYING SECTION

(75) Inventor: Bruce Barrie, Waseca, MN (US)

(73) Assignee: Barrie Archery, LLC, Waseca, MN (US)

( * ) Notice: Subject to any disclaimer, the term of this patent is extended or adjusted under 35 U.S.C. 154(b) by 15 days.

(21) Appl. No.: 09/629,905

(22) Filed: Jul. 31, 2000

(51) Int. Cl.[7] ..... F42B 6/08

(52) U.S. Cl. ..... 473/584

(58) Field of Search ..... 473/578, 582, 473/583, 584, FOR 216, FOR 219, FOR 221, FOR 222

(56) References Cited

U.S. PATENT DOCUMENTS 4,093,230 * 6/1978 Simo ..... 473/583
4,254,958 * 3/1981 Bateman ..... 473/583
4,579,348 * 4/1986 Jones ..... 473/583
4,807,889 * 2/1989 Johnson ..... 473/584
5,322,297 * 6/1994 Smith ..... 473/583
5,820,498 * 10/1998 Maleski ..... 473/584
5,857,930 * 1/1999 Troncoso ..... 473/583
6,015,357 * 1/2000 Rizza ..... 473/583

* cited by examiner

*Primary Examiner*—John A. Ricci
(74) *Attorney, Agent, or Firm*—James R Cwayna

(57) ABSTRACT

A broadhead including a main body portion and a replaceable blade carrying portion having at least a pair of blades on the blade portion. This structure permits removal and replacement of the blade portion to provide new blades of the same style or provide blades of another selected style. Such a selected style may include pivotally mounted blades which are folded for in-flight and travel and which expand rearwardly upon striking a target to present a large cutting dimension or may include stationary blades of predetermined cutting dimension. This concept allows the user to simply switch from dull to sharp blades or change styles from an expandable to a stationary type broadhead or vice-versa, by simply changing the blade carrying portion while utilizing the same man body portion. The pivotally mounted blades provide a folded, in-flight, position. When this style impacts the target, the blades pivot to their expanded cutting position exposing the cutting edge of each blade. When selecting the stationary style which provides a fixed position blade wherein the cutting edges will always be exposed. In either instance, the blade carrying body is prevented from rotating about the main body portion in the in-flight or target striking position.

14 Claims, 3 Drawing Sheets

BROADHEAD WITH REPLACEABLE BLADE CARRYING SECTION

SPONSORSHIP

This invention is not made under any Federally related nor Independent Sponsorship and is the result of the efforts of the sole inventor.

RELATED APPLICATIONS

Applicant has no and is not aware of any pending applications by others which relate to this application or the invention disclosed herein.

FIELD OF THE INVENTION

This invention relates generally to broadhead arrows and more specifically to broadhead arrows which include a primary body portion and a blade carrying section which blade carrying section is removable from the primary body portion for either replacement of dulled blades or for changing the style of blade being used by the user. The first style of selectable blades include expandable blades which are maintained in a folded, in-flight position and which expand to an increased cutting dimension upon the broadhead striking a target surface. A second style of blades includes a stationary blade or blades of a constant cutting dimension. In either selection, the blade carrying section is prevented from rotating relative to the primary body portion during flight and when striking and entering the target.

SHORT SUMMARY OF THE INVENTION

A broadhead arrow having a primary body portion which is attachable to the front of an arrow shaft and a blade carrying section which is removable from the primary body portion when the primary body portion is removed from the arrow shaft. Thereafter the blade carrying section is replaceable to allow the user to replace the same, as a unit, with sharp blades or to select a new blade carrying section which has blades of a different style than that previously used.

The penetrating, forward end of the primary body may be either conically tapered or may include cutting edges. Either type of penetrating end may be integral with the primary body or may be attached thereto.

The blade carrying section is prevented from rotation with respect to the main body portion during in-flight and target string conditions.

At least two styles of blades which are of most common usage are disclosed herein.

The first style is of the expandable type wherein the blades carried by the blade carrying section are pivotally mounted thereon to provide a reduced, in-flight, dimension and wherein the blades pivot upon striking a target to expose the cutting surfaces thereof and provide a cutting surface of greater dimension than that of the in-flight dimension.

The second style is referred to as a stationary blade wherein the blades are not moveable and remain in a single position with the cutting edge thereof being constant dimension and continually exposed. These blades may be vented.

PRIOR ART

The known prior art does not disclose a broadhead arrow having two distinct, separable sections, one section forming a primary body portion with the second section providing a blade carrying section with the selected style blades of the broadhead being carried thereby. Such a structure allows for replacement of blades with either sharp blades of the same style or a blade style and configuration which differs from the first style being used.

OBJECTS AND ADVANTAGES OF THE INVENTION

The style of broadhead used in hunting varies from individual to individual and is often governed by various district laws.

Certain hunters prefer a broadhead which expands upon striking a target but which has a relatively small diameter while in the in-flight position. Other hunters prefer a non-expandable broadhead which has exposed blades of a constant effective cutting diameter during flight and upon striking the target.

To this time it has been necessary for an archer to select one or the other style for use or to carry two distinct styles for use at his or her option.

With applicant's invention, a relatively simple, but heretofore unused concept is provided. This is the utilization of a blade carrying section of the broadhead to be removable from and replaceable upon a major body portion of the broadhead with the blade carrying portion providing the blade selection.

It is therefore an object of the applicant's invention to provide a broadhead for attachment to an arrow shaft which provides at least two distinct elements, these being a main body portion having a forward penetrating end and a rearward shaft attachment section with a blade carrying section receivable on the rearward shaft attachment section of the main body portion.

It is a further object of the applicant's invention to provide a broadhead which includes a main body portion and a blade carrying section with the blade carrying section provided with blades of distinct style for interchanging of blade styles at the option of the archer.

It is a further object of the applicant's invention to provide a broadhead which includes a main body portion and blade carrying section with a first style of blades of the blade carrying section being forwardly foldable for in-flight travel and pivoting upon the blade carry section to a rearward, open position thus providing an enlarged, effective, cutting diameter.

It is a further object of the applicant's invention to provide a broadhead which includes a main body portion and a blade carrying section with the blade carrying section provided with at least a second style of blade consisting of two or more stationary blades with exposed cutting surfaces of a preselected constant cutting diameter.

It is still a further object of the applicant's invention to provide a broadhead which includes a main body portion and a separable blade carrying section with means provided between such portion and section to prevent relative rotation therebetween during flight or upon striking the intended target.

It is yet a further object of the applicant's invention to provide a broadhead which includes a penetrating tip which is integral or attachable to the main body portion thereof These and other objects and advantages of the applicant's invention will more fully appear from a consideration of the accompanying drawings and disclosure.

SHORT DESCRIPTION OF THE DRAWINGS

Figure 8:
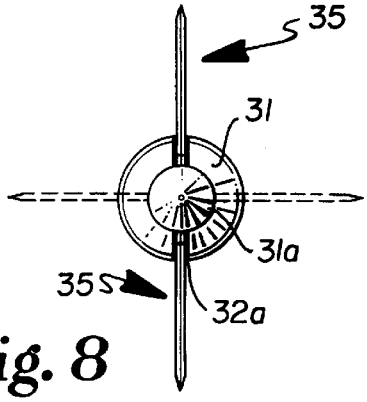
FIG. 8 is a front elevation of FIG. 7 and illustrating two additional blades, in dotted lines, to show that more than two blades will normally exist on this style of broadhead.
Figure 10:
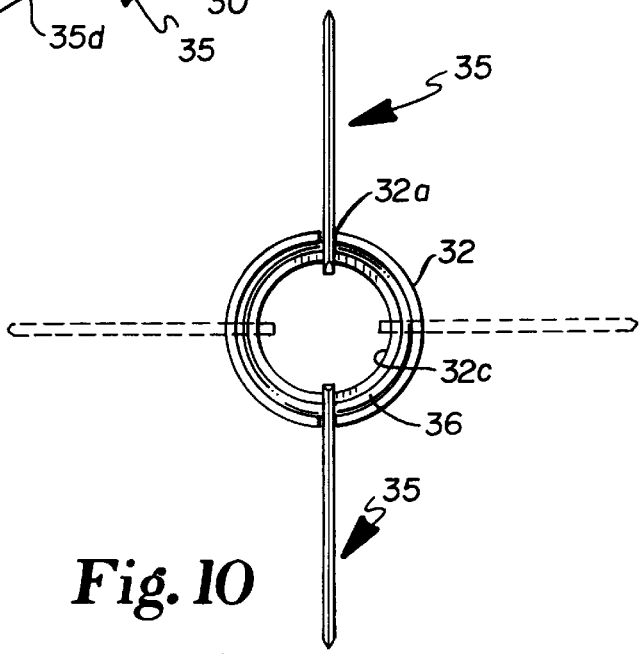
FIG. 10 is a front view of the blade carrying section of the broadhead taken substantially along Line 10—10 of FIG. 9; and, FIG. 11 is a side view of a single stationary blade of FIGS. 7 through 10.
Figure 9:
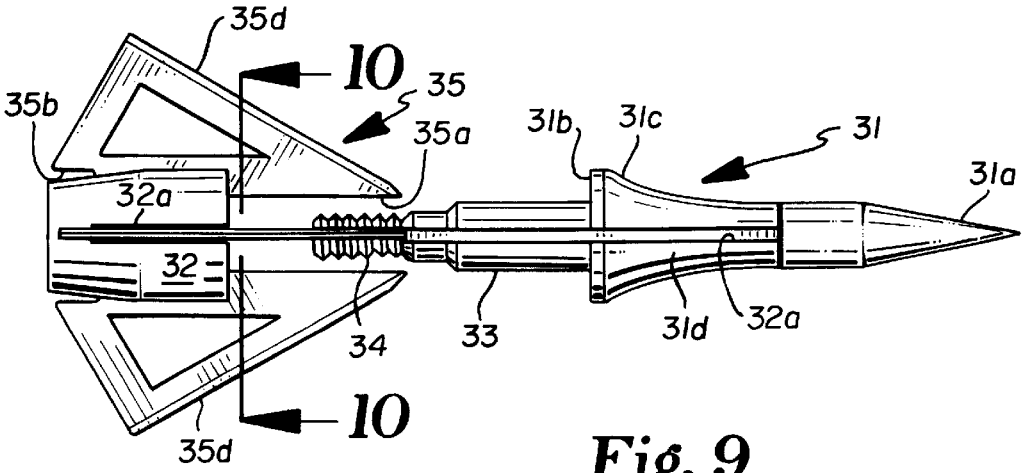
FIG. 9 is a view similar to FIG. 4 illustrating the primary body removed from the arrow shaft and the removability of the blade carrying section from the primary body.

(It should be noted that FIGS. 8 and 10 are drawn to different scales.)

DESCRIPTION OF A PREFERRED FORM OF THE INVENTION

The preferred form of the invention and the primary invention disclosed herein is a broadhead wherein a primary or main body portion is arranged for attachment to an arrow shaft with a removable blade carrying section arranged on the main body portion and normally held thereon by the association of the main body portion with the arrow shaft.

Several distinct styles of broadhead are known and used by archers and these include expandable blades and stationary blades. This disclosure relates to the utilization of both such types in conjunction with the removable blade carrying section of the broadhead.

The description of the expandable type includes the drawings of FIGS. 1–6 while the description of the stationary type includes the drawings of FIGS. 7–11.

As shown in FIGS. 1–6, the expandable broadhead is generally designated 11 and includes a primary or main body portion 12 and a blade carrying section 13. The main body 12 includes a longitudinally extending solid body including an integrally formed or an attachable penetrating end 14 and an attachment end 16. Two forms of a penetrating end 14 are also illustrated in the drawings and this first form, FIGS. 1–6, includes a plurality of angularly arranged surfaces 14*a* extending rearwardly from the foremost end of such tip to provide cutting edges 14*b* therebetween. Rearwardly of tip 14 is a flare section 14*c* which is provided simply as a transitional shape which extends to a reduced body portion 15 and an attachment end 16 which is, in the form shown, threaded for attachment to an arrow shaft S. As illustrated, a plurality of longitudinally extending grooves 17 are provided on main body 12 and extend to include the reduced diameter section 15.

Blade carrying section 13 includes a longitudinally extending body having a longitudinal passage therethrough for receipt upon section 15 of main body 12. The frontal surface 13*a* of blade carrying section abuts with the rear of the main body 12 and both abutting surfaces are normal to the axis of the two bodies 12, 13. A blade receiving slot 13*b* extends at least partially within body 13 and the end thereof limits pivotal movement of blades 20 from the in-flight position of FIG. 1 to the expanded position of FIGS. 2 and 4.

Figure 5:
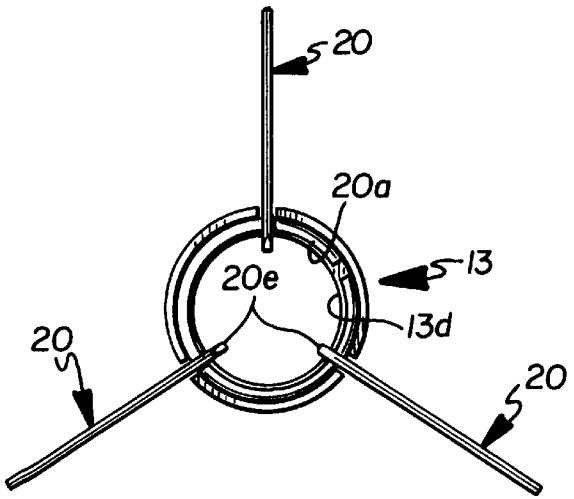
FIG. 5 is a front view of the blade carrying section of the broadhead taken substantially along Line 5—5 of FIG. 4.

As illustrated in FIG. 5, the blade carrying section 13 includes an internal shoulder 13*d* upon which a split ring 20*a* or other holding means functioning to hold the blades 20 to the body 13, is received.

Figure 6:
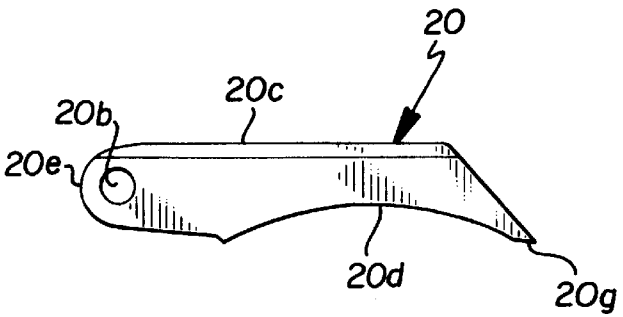
FIG. 6 is a side view of a single pivotal blade.

A typical individual blade 20 is illustrated in FIG. 6. As shown therein each of the blades includes a split ring 20*a* receiving aperture 20*b* allowing the same to pivot from in-flight to expanded position. Blades 20 are provided with a sharpened or sharpenable, straight cutting surface 20*c* on one side thereof with the other side 20*d* being curvilinear in shape. The cutting surface 20*c* and curvilinear surface 20*d* terminate in an actuation end 20*g* which causes pivoting of the blade 20 upon the broadhead striking a target.

Figure 1:
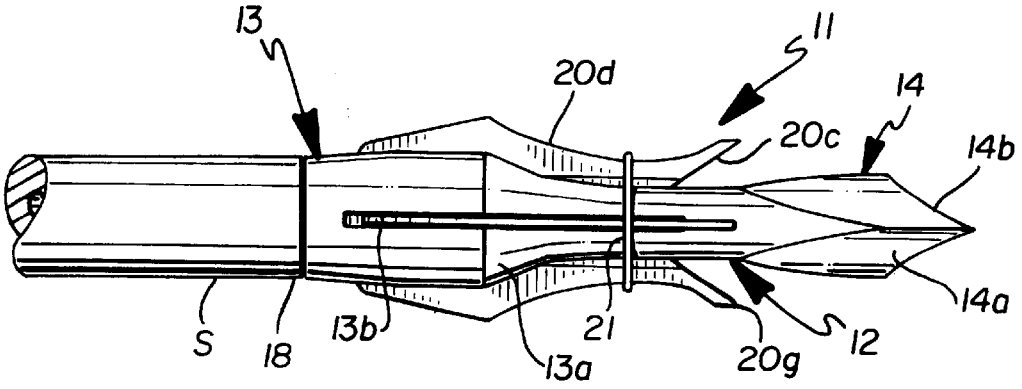
FIG. 1 is a side elevation of a broadhead embodying the concepts of the applicant's invention and illustrating an expandable blade style with the blades being shown in folded, in-flight position.
Figure 2:
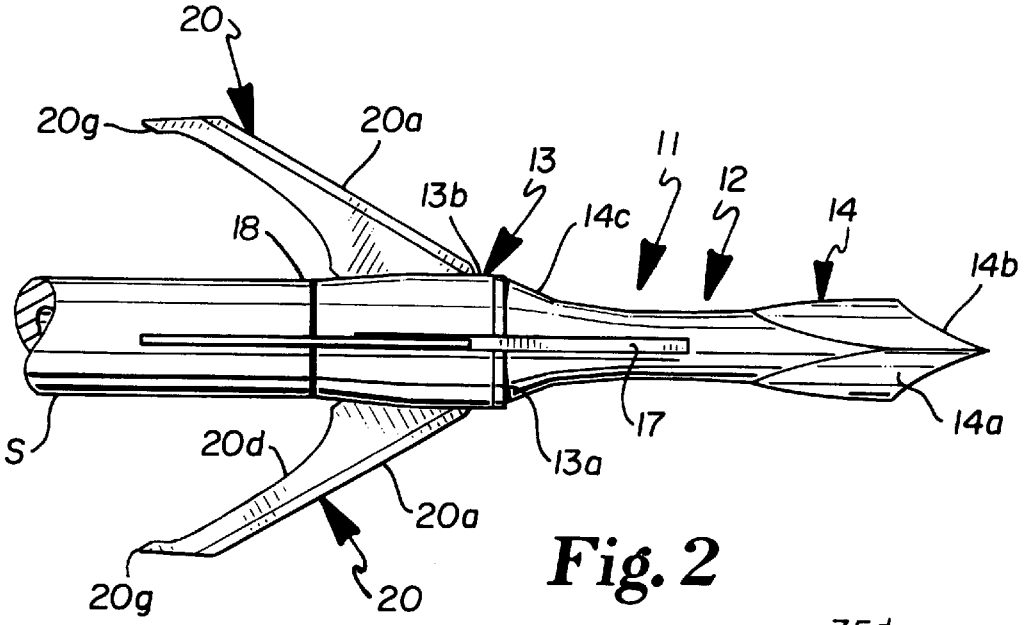
FIG. 2 is a side elevation of the broadhead of FIG. 1 illustrating the blades in expanded, target penetrating position.

As best illustrated in FIG. 1, this actuation end 20*g* is without the dimension of the penetrating tip 14.

A rotation prevention extension 20*e* is provided on the end of the blade 20 adjacent ring receiving aperture 20*b* and, as shown in FIG. 5 will extend into the inner diameter of the blade carrying section 13 and thus into groove 17 of main body 12.

When the blades 20 are in folded, in-flight position, they will lie in the aforementioned slots 17 of the main body portion 12 and upon pivoting thereof, the extension 20*e* will remain within such slots 17 thereby preventing relative rotation between the main body portion 12 and the blade carrying section 13. Obviously other internal extentions could be provided to accomplish this same rotation prevention.

Figure 3:
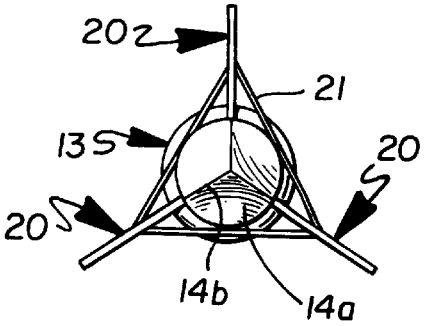
FIG. 3 is a front view of the broadhead.
Figure 11:
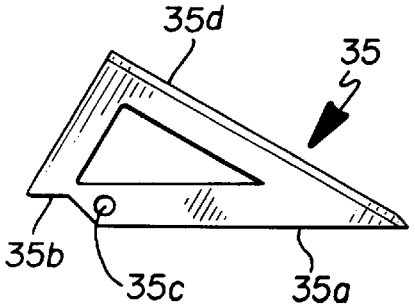
Figure 4:
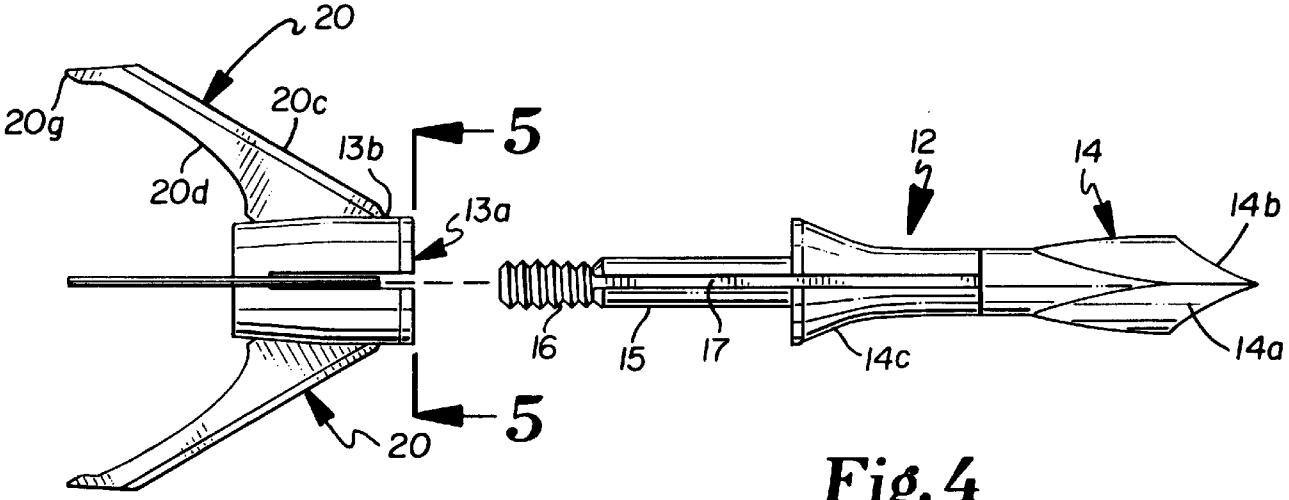
FIG. 4 is a side elevation of the broadhead of FIG. 2 illustrating the primary body removed from the arrow shaft and the removability of the blade carrying section from the primary body portion.

When in folded, in-flight position, the blades 20 are held, as shown in FIGS. 1 and 3, with an expendable or reusable retention ring 21. Such ring 21 may be made of various materials, such as elastomers. Other means such as friction or go, no-go devices may be used to hold the blades 20 in the in-flight position.

As illustrated, retention ring 21 may be located anywhere along the curvilinear surface 20*d* of the blades 20 to retain the blades in folded, in-flight position.

When the broadhead 11 strikes a target and the actuation ends 20*g* strike the target, the blades 20 will pivot about split ring 20*a* into expanded position overcoming the retention ring 21.

Although the applicant has chosen to illustrate three such blades 20 on the blade carrying section 13 this number may be varied without departing from the scope of the invention.

Selectively. as illustrated, the number of blades, 20, cutting edges 14*b* of penetrating tip 12 and grooves in the bodies, 17, 13*b* may be correlated and longitudinal alignment of the same may be maintained.

The stationary form of blade is illustrated in FIGS. 7 through 11. In this form the concept of the invention is the same as that illustrated in FIGS. 1 through 6, which is to provide a broadhead 30 having a main body portion 31 and a blade carrying section 32.

Figure 7:
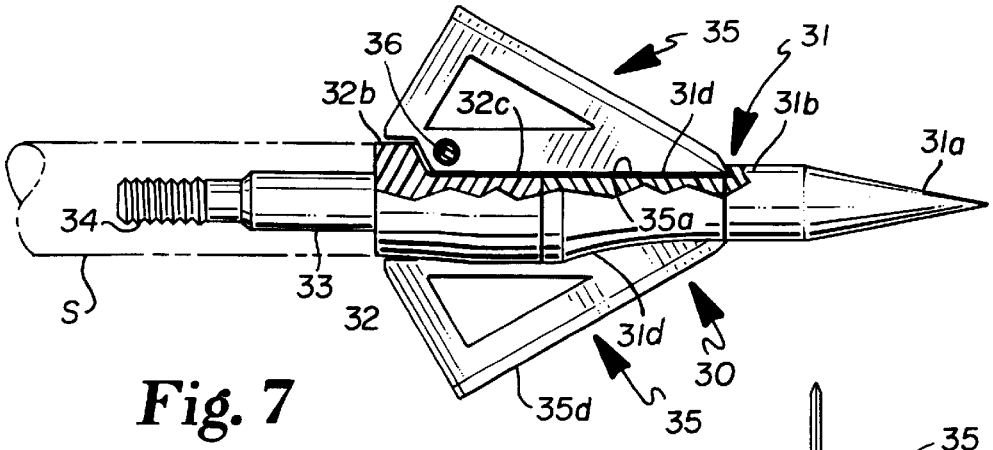
FIG. 7 is a side view of a broadhead illustrating a second style of blades utilizing stationary blades and having portions thereof broken away for illustrative and description purposes.

FIG. 7 illustrates two blades 35 on the blade carrying section 32 and this has been selected as permitting a better showing of the individual blades 35 but applicant has found that, as illustrated by the dotted line blades of FIGS. 8 and 10, that more than two such blades 35 are desirable and the average archer will prefer three blades.

The penetrating tip 31*a* of the main body portion 31 is, in this form a simple cone of a, smooth, taper form which may be integral with or attached to the main body portion 31 but having an undercut 31*b* at the ultimate longitudinal end thereof to receive the forward end of the blades 35. Again, the main body 31 may flare outwardly as at 31*c*. and a longitude groove 31*d* is provided in such main body 31 to receive one side 35*a* of blades 35.

The main body portion 31 again includes a reduced diameter length 33 and a threaded attachment end 34 to be received into an arrow shaft S.

The blade carrying section 32 provides a longitudinally extending body 33 having a longitudinal groove 32*a* which terminates in a shoulder 32*b* against which a reverse shoulder 35*b* of blade 35 will abut.

As illustrated in FIG. 10, to hold the blades 35 of this broadhead to the blade carrying section 32, an internal shoulder 32*c* is provided and a split ring 36 is provided thereon to pass through aperture 35*c* of the blades 35 to secure the same to blade carrying section 32.

In this instance, the blades 35 are generally three sided with the reverse shoulder 35*b* being considered with one side 35*a* thereof being receiveable into blade carrying section slot 32*a*, main body slot 31*d* and the ultimate tip thereof received into cavity 31*b* rearward of the penetrating tip 31*a*. One side 35*d* will present a sharpened cutting surface as it enters the target.

Again, with this stationary blade style, the blades 35, will rest within the communicating grooves of both the blade carrying section 32 and the main body portion 31 with movement thereof being prevented by the combination of the blade carrying section shoulder 32*b* and reverse shoulder 35*b* of blade 35. The undercut cavity 31*b* of the penetrating tip also assists to hold the blade 35 in stationary position.

With this style of stationary blade, the most common usage will be of 3 blades but, obviously, this number may be modified without departing from the scope of the invention.

As this is a stationary blade style, the nesting for the blades wit the aforementioned grooves will prevent rotation of the blade carrying section 32 relative to the main body portion.

In either form of the invention, it should be obvious that simply removing the main body portions from the arrow shaft S will allow removal of the blade carrying sections for either replacement of the blade carrying section having the same style blades or blades of a different style but it should be obvious that the removable blade carrying section may be maintained to or removable from the primary body with other arrangements of body parts which could include a sectionable primary body, frictional holding means between these two portions or, even, a frontal mounted blade carrying section with the penetrating tip holding the blade carrying section to the primary body.

Although possible to sharpen and reuse the same blades, applicant believes that field sharpening will not be desirable while replacement of the blade carrying section containing the new blades of either selected style will be the effective method of utilization.

In either showing of the invention, the concept is to provide a totally removable and replaceable blade carrying section allowing the archer great flexibility in his or her selected shooting.

What is claimed is:

1. A broadhead for attachment to an arrow shaft, the broadhead including:

a. a longitudinally extending main body portion, having a penetrating, forward end and extending rearwardly therefrom to an arrow shaft attachment end;

b. a removable blade carrying section arranged to be received and removably retained to said main body portion;

c. said removable blade carrying section having at least a pair of blades thereon; and, d. rotation prevention means between said main body portion and said blade carrying section.

2. The broadhead as set forth in claim 1 and said blades of said blade carrying section being pivotally mounted thereon to permit forward folding of said blades for an in-flight position.

3. The broadhead as set forth in claim 2 and said pivotally mounted blades being provided with a cutting surface and a forwardly directed actuation end pivotally shifting said blades from said forward, folded position to a rearwardly directed expanded penetrating position upon striking a target whereby the cutting surface is exposed.

4. The broadhead as set forth in claim 3 and said removable blade carrying section being provided with a plurality of blades.

5. The broadhead as set forth in claim 4 and means for retaining said pivotally mounted blades in folded position when the broadhead is in the in-flight position.

6. A broadhead for attachment to an arrow shaft, the broadhead including:

a. a longitudinally extending main body portion, having a penetrating, forward end and extending rearwardy therefrom to an arrow shaft attachment end;

b. a removable blade carrying section arranged to be received and removably retained to said main body portion;

c. at least one longitudinally extending slot provided on said main body portion;

d. at least one longitudinally extending slot provided on said removable blade carrying section in alignment with said main body portion slot;

e. a blade member arranged in said slot; and, f. means for retaining said blade member in said slot and preventing movement thereof from said slot.

7. The broadhead as set forth in claim 6 and said blade having a forward and rearward end, said means for retaining said blade member in said slot and preventing movement from said slot including a shoulder on said rearward portion of said blade carrying section and a shoulder receiving portion on the rearward portion of said blade.

8. The broadhead as set forth in claim 6 and said means for retaining said blade member in said slot and preventing movement from said slot including a blade tip receiving area on a rearward end of said forward, penetrating end, said forward end of said blade being received therein.

9. The broadhead as set forth in claim 6 and at least a pair of slots arranged on and arcuately spaced about said main body portion and said removable blade carrying section, a blade member arranged in each of said slots.

10. The broadhead as set forth in claim 9 and each of said blade members providing a cutting surface on the outermost portion thereof.

11. A broadhead for attachment to an arrow shaft, the broadhead including:

a. a longitudinally extending main body portion, having a penetrating, forward end and extending rearwardly therefrom to an arrow shaft attachment end;

b. a removable blade carrying section arranged to be received and removably retained to said main body portion;

c. said removable blade carrying section having at least a pair of blades thereon, said blades being pivotally attached to said blade carrying section to permit forward folding of said blades to an in-flight position and pivoting to a rearwardly directed, expanded penetrating position upon striking a target; and, d. a rotation prevention means between said main body portion and said blade carrying section.

12. The broadhead as set forth in claim 11 and said pivotally mounted blades being provided with a cutting surface and a forwardly directed actuation end pivotally shifting said blades from said forward, folded, in-flight, position to a rearwardly directed expanded, penetrating position upon striking a target whereby the cutting surface is exposed.

13. The broadhead as set forth in claim 11 and said blade carrying section being provided with a plurality of blades.

14. The broadhead as set forth in claim 11 and means for retaining said pivotally mounted blades in folded position when the broadhead is in the in-flight position.

* * * * *